United States Patent [19]

Obuch et al.

[11] 4,174,148

[45] Nov. 13, 1979

[54] ELECTRICAL TERMINAL CLAMP ASSEMBLY

[75] Inventors: Edward A. Obuch, Linden; Paul T. Filak, Roselle Park, both of N.J.

[73] Assignee: Amerace Corporation, New York, N.Y.

[21] Appl. No.: 861,417

[22] Filed: Dec. 16, 1977

[51] Int. Cl.[2] ..... H01R 9/10

[52] U.S. Cl. ..... 339/246; 85/50 R

[58] Field of Search ..... 339/95 R, 246; 85/50 R, 85/50 C

[56] References Cited

U.S. PATENT DOCUMENTS

| | | | |
|---|---|---|---|
| 812,287 | 2/1906 | Nagel | 339/246 |
| 3,177,456 | 4/1965 | Haydu et al. | 339/246 |
| 3,788,185 | 1/1974 | Gutshall | 85/50 R |
| 3,891,296 | 6/1975 | Gutshall | 339/246 |

*Primary Examiner*—Joseph H. McGlynn

*Attorney, Agent, or Firm*—S. Michael Bender; Ken Richardson

[57] ABSTRACT

An electrical clamp assembly of the type for securing electrical conductive elements to an electrical device, such as an electrical terminal, comprises an interconnected clamping plate and screw. Bearing surfaces between the clamping plate and screw head comprise an anti-friction ball joint. The ball joint provides a means for converting the entire amount of tightening-torque applied to the screw head to substantially an equivalent amount of clamping force at a clamping surface of the plate by minimizing frictional resistance between the bearing surfaces. A race-like portion of the ball joint also provides a means for inseparably holding the plate about an unthreaded portion of a partially threaded screw shank without allowing the plate to harmfully abuttingly interfere with the threads of the screw. A plurality of ribs are disposed on the bottom surface of the plate to form a rhombus-like pattern and to prevent lateral slipping of the conductive wire during torquing of the screw.

14 Claims, 4 Drawing Figures

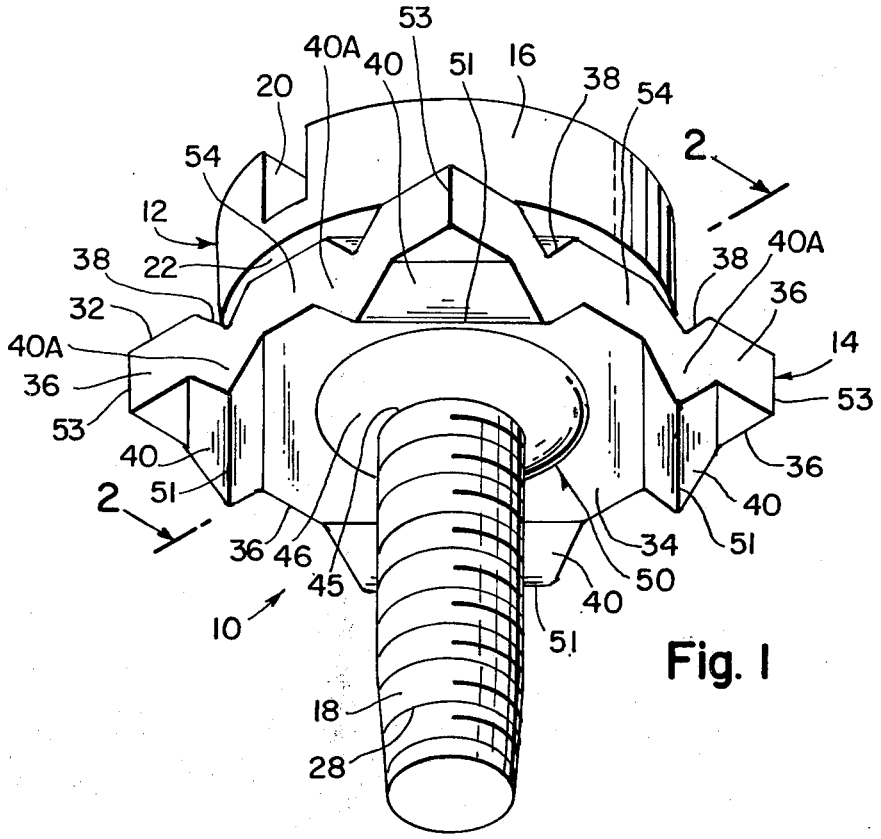
Fig. 1
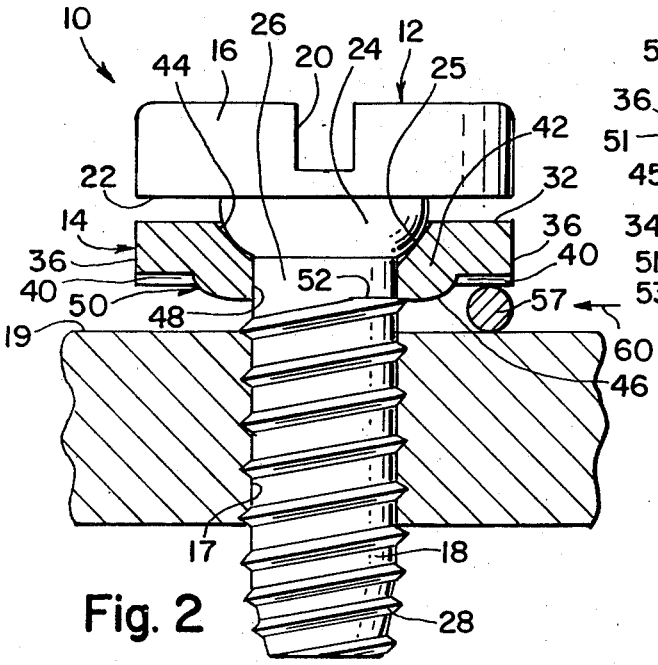
Fig. 2
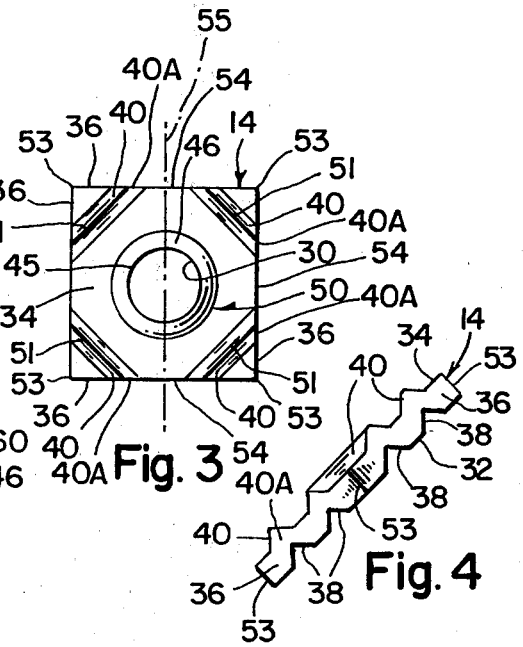
Fig. 3
Fig. 4

ELECTRICAL TERMINAL CLAMP ASSEMBLY

The present invention relates generally to an electrical terminal clamp assembly, for securing electrically conductive elements to an electrical terminal.

A wide variety of electrical terminal clamp assemblies are currently available for holding electrically conductive wires to terminals of electrical devices or equipment such as, terminal blocks, terminal lugs and bus bars to name a few. A pressure or clamping plate is utilized under the torqued head of a screw to transmit tightening-torque applied to the screw head, via a bearing shoulder of the screw head, to the clamping plate. The clamping plate provides pressure in the form of a clamping load, pullout-load, holding force or clamping force to a conductor or conductors positioned beneath the plate. The conductors are captivated or held between the clamping plate and a confronting surface of the terminal or device. The confronting surface, typically, has a threaded aperture therein for receiving the torqued screw. Such assemblies must be capable of positively holding or clamping the conductors to the device in a manner to meet design specifications; safeguard against the potentialities of electrical hazards resulting from loose electrical connections or conductors becoming free; and meet accepted tightening-torque and pullout-load performance standards as set forth, for example, by Underwriters Laboratories Inc.

Many structural features have been taught in the prior art in both the clamping plate and clamping screw to meet the tightening-torque and pullout-load performance standards suggested by Underwriters Laboratories Inc. A substantial number of these structural features involve provisions for bumps, serrations, or ribs on either one or both sides of the pressure plate. Yet, other structural features involve provisions for variations in the configuration of either the shank and/or bearing shoulder of the screw head. A common problem with existing pressure plates is the inability of the formation of bumps, serrations, or ribs thereon to prevent conductors from squeezing or slippng away from under the pressure plate in a lateral direction away from the screw shank. This mode of slipping is induced by the resistance of the conductors to the tightening-torque applied to the screw head. It often occurs at all accepted levels of applied tightening-torque and may lead to a faulty electrical connection as well as a poor mechanical connection.

Another common problem concerns the inability of prior art terminal assemblies to convert the entire amount of tightening-torque, applied to the screw head, to substantially an equivalent amount of clamping force or pullout-load at the clamping plate. A principal obstacle preventing the process of a full conversion is frictional resistance. Such frictional resistance between the bearing or mating surfaces of the clamping screw head and the pressure plate increases the amount of tightening-torque needed to obtain safe levels of holding power. A significant portion of the applied tightening-torque loss is expanded or exerted as heat energy in the act of overcoming the frictional resistance. This significantly reduces the magnitude of tightening-torque that is transmitted and converted to a clamping force at the clamping plate, thereby decreasing the effectiveness of the holding force exerted by the clamping plate. The effectiveness of the holding force will be reduced even though the tightening-torque is applied at levels accepted by the industry.

Frictional resistance in some assemblies is somewhat minimized by positioning bumps, serrations or ridges at the bearing surfaces between the screw head and pressure plate. However, these structural features have not satisfactorily decreased the frictional resistance to completely transform the full amount of the tightening-torque to an equivalent amount of clamping load. Yet, other assemblies provide the bearing shoulder of the screw head with a spherical shaped surface, which seats within a plate or washer adjacent the pressure plate, to reduce frictional resistance. The use of two plates, that is, the seating plate or washer and the pressure plate in these assemblies, although reducing tightening-torque losses to some degree, still prevents all of the applied tightening-torque to be substantially fully converted to an equivalent amount of clamping force.

Another problem in many prior art assemblies arises due to the clamping plate harmfully interfering with or damaging the external threads of the screw shank. In these assemblies, the screw shank includes an unthreaded neck portion adjacent the bearing shoulder of the screw head. The unthreaded neck portion is intended to hold the clamping plate thereabout in an inseparable assembly. To prevent the clamping plate from harmfully interfering with the external threads, which could lead to among other things: binding between the plate and screw threads; stripping of the threads; a bad mechanical connection; and less than a full process of tightening-torque conversion; a screw thread is provided with a 360° thread or ridge between the unthreaded portion and the threaded portion of the shank. However, the addition of the 360° thread calls for extra tooling and machining, undesirably prevents the use of standard screws, and increases the manufacturing and production costs associated therewith.

Against the foregoing background, it is an object of the present invention to provide an electrical terminal clamp assembly, of a type for holding electrical conductors to an electrical device with a clamping plate and screw, capable of substantially completely converting any accepted level of applied tightening-torque, as required by industry standards such as those set by Underwriters Laboratories Inc., to substantially an equivalent and accepted level of clamping load, while virtually eliminating tightening-torque losses due to frictional resistance.

It is another object of the present invention to provide an electrical terminal clamp assembly, of a type having a clamping plate and screw for holding electrical conductors to an electrical device, capable of preventing the conductors from squeezing or slipping in a lateral direction away from the screw shank and out from under the clamping plate.

It is yet still another object of the invention to provide an electrical terminal clamp assembly, of a type having a clamping plate and screw for holding electrical conductors to electrical terminals or devices, capable of holding the clamping plate about an unthreaded portion of a partially threaded screw shank in an inseparable assembly without allowing the clamping plate to harmfully abuttingly interfere with the threaded portion of the shank.

The above objects, as well as still further objects and advantages, are attained by the invention which may be described briefly as providing in an electrical terminal clamp assembly of the type for holding electrical conductive elements to an electrical terminal or other device, the improvement comprising a screw having a head and a partially threaded shank extending from the head, the underside of the head being provided with a generally convex-shaped bearing portion, a plate having a first surface for receiving the screw head and a second surface, the second surface including means adaptable for securely holding the conductive elements between the second surface and a surface of the terminal or other device without slipping or lateral displacement thereof, the plate also having a race means adaptable for receiving therein the shank, the race means having a concave-shaped seating surface on the bearing surface of the plate for receivably seating the convex-shaped bearing portion of the head and a convex-shaped collar means depending from the clamping surface, the collar means being adaptable for retaining the plate on an unthreaded portion of the shank without interfering with the threaded portion, and wherein the convex-shaped bearing portion of the head and the race means provide a ball joint means when the screw is assembled into the plate, the ball joint means enabling the entire amount of tightening-torque applied to the screw to be converted to substantially an equivalent amount of clamping force at the second surface, by decreasing the frictional resistance between the convex-shaped bearing portion and the concave-shaped seating surface.

The invention will be more fully understood, while still further objects and advantages thereof will become more apparent, in the following detailed description of embodiments of the invention illustrated in the accompanying drawing, in which:

FIG. 1 is a perspective view of an electrical terminal clamp assembly constructed in accordance with the invention;

FIG. 2 is a front view in section of the electrical terminal assembly of FIG. 1 as taken along lines 2—2 of FIG. 1;

FIG. 3 is a bottom view of the clamping plate employed in the electrical terminal clamping assembly of FIG. 1; and FIG. 4 is a side view of the clamping plate of FIG. 3.

Referring now to FIGS. 1-4 of the drawing, a preferred form of an electrical terminal clamp assembly 10 is shown for clamping conductive elements to the terminal of an electrical device or equipment. Thus, for example, assembly 10 may be utilized to securely hold an electrically conductive wire or plurality of wires to the terminal end of an electrical terminal block as disclosed in U.S. Pat. No. 4,040,700, assigned to the same assignee as the present application, and which is incorporated herein by this reference. Of course, it will be understood that the screw and clamping plate of the present invention may be employed with other forms of terminal so long as the latter includes a suitable aperture for threadably engaging or receiving the threaded portion of a screw. Thus, the component parts of assembly 10 comprise a screw 12 preferably inseparably interconnected with a clamping plate 14.

Screw 12, as well as clamping plate 14, may be constructed from any material of suitable strength and conductivity so that the material will provide an electrical connection between the wires and the terminal which meets design specifications and tightening-torque and pullout-load levels in accordance with the performance standards of Underwriters Laboratories Inc. To this accomplishment steel is the preferred base material from which the screw 12 and clamping plate 14 are constructed.

Screw 12 is provided with a screw head 16 and at least a partially externally threaded screw shank 18 extending therefrom. Screw head 16 may comprise any one of numerous configurations suitable for applying a satisfactory tightening-torque thereto, such as a non-slotted hexagon head, or a head having a recess therein for receiving torquing tools have a shape conforming to the shape of the recess, like for example, an Allen wrench. Screw head 16, however, preferably has a cylindrically shaped head which includes a slot 20 therein as substantially shown in FIGS. 1 and 2 and which is adaptable for receivably engaging a conventional screwdriver whereupon the screwdriver may be employed to transfer torque to the screw head. Extending between under surface 22 of screw head 16 and the shank 18 and integral therewith is a hemispherical or convex-shaped surface defining a ball portion 24 as best seen in FIG. 2.

Shank 18, which in turn depends from ball portion 24, and which includes a threaded lower portion 28, is of a length and diameter with respect to the size of screw head 16 to adequately handle the various levels of tightening-torque applied to screw head 16, when the screw is threadably engaged in a complementary threaded aperture 17 in the terminal or terminal surface 19 as schematically depicted in FIG. 2. If desired the distal extremity of the threaded portion 28 may be tapered slightly to facilitate insertion thereof into a mating aperture or recess. Shank 18 is also provided with an unthreaded or plain diameter portion 26 extending between ball portion 24 and threaded portion 28. Unthreaded portion 26 is of an axial length and diameter to rotatably seat or fit within an unthreaded aperture 30 in clamping plate 14 as will be more fully explained hereinafter.

External threads of threaded portion 28 may comprise any one of the various well known conventional series and classes of threads, as well as nonconventional thread series and classes. External threads 28, however, are preferably thread series #6-32 class NC-2. External threads 28 are formed on shank 18 subsequent to its insertion into aperture 30 using known methods of thread rolling as will be more fully explained hereinafter.

Clamping plate 14 preferably comprises a rectangular plate-like configuration having an upper bearing surface 32, a lower clamping surface 34 and four sides 36, but, however, is not limited to this shape. For example, plate 14 could also comprise a cylindrical shape, hexagon shape, or any other configuration that would be adaptable for enabling plate 14 to be provided with the unique arrangement of clamping ribs or jaws 40 of the present invention depending from clamping surface 34, as will be more fully explained hereinafter. Clamping plate 14 is of a thickness suitable for distributing and converting tightening-torque transmitted to clamping plate 14, via screw head 16, to the desired clamping force or holding power, or pullout-load. Clamping plate 14 is also of a thickness and ductility to satisfactorily physically withstand without failure stamping, punching, pounding, drilling or other equivalent forming operations conducted on bearing surface 32.

Desired ones of such forming operations are utilized to obtain a plurality of V-shaped grooves or slots 38 within bearing surface 32 which grooves in turn alter opposed clamping surface 34 by providing protruding or complementary inverted V-shaped clamping ribs or jaws 40 thereon, and an anti-friction race-like structure generally designated by reference numeral 42 comprising a concave portion 44 disposed in bearing surface 32 in such a manner as to alter opposed clamping surface 34 and provide therein protruding complementary convex-shaped portion 46. The desired forming operation is also utilized to provide the aforementioned through aperture 30 which axially extends between concave portion 44 and its complementary convex portion 46. See FIG. 2. It is to be noted that the convex portion 46 is of dome-like shape and is substantially centered on the underside of clamping plate 14 with respect to aperture 30. Consequently, aperture 30 is situated at the vertex portion 45 of the dome-like shaped portion 46 of race 42.

Concave seating portion 44 of race 42 has a bowl-like shape that is complementary to the hemispherical or convex-shape of ball portion 24, such that, ball portion 24 is seated within concave portion 44 of race 42 when shank 18 of screw 12 is inserted into or through aperture 30 in clamping plate 14 as shown in FIG. 2. Concave portion 44 may be deep or shallow depending upon the shape of ball portion 24. Preferably, however, concave portion 44 has a radius of curvature greater than that of ball portion 24 such that limited or line contact exists between the surface of concave portion 44 and the surface of ball portion 24 thereby minimizing rolling friction between these contacting surfaces. Thus, when ball portion 24 is seated within concave portion 44, ball portion 24 makes contact with concave surface portion 44 along a relatively narrow circumferentially extending line or race 25, as is substantially shown in FIG. 2. The curvature of concave surface portion 44 has been slightly exaggerated to indicate this feature. As a consequence of the aforesaid, ball portion 24, during torquing of screw 12 into a complementary threaded aperture in an electrical terminal or device, is enabled to rotate along contact region or race 25 with minimal frictional resistance between the mating surfaces associated with ball portion 24 and concave portion 44. Thus, when screw 12 is being torqued, ball portion 24 and concave portion 44 behave as an anti-friction ball joint substantially avoiding tightening-torque losses by minimizing frictional resistance between the opposed bearing surfaces and substantially extends the useful life of assembly 10 by reducing wear and failure caused by frictional resistance. Moreover, since losses due to frictional resistance are negligible, the full amount or magnitude of tightening-torque applied to screw head 16 is converted to substantially an equivalent amount or magnitude of clamping force at clamping plate 14. Additionally, the anti-friction ball joint enables screw 12 to be adjusted slightly during tightening into a complementary aperture in a terminal surface to accommodate misalignments therebetween. To facilitate this latter function, the diameter of through aperture 30 is sized slightly greater than the outer diameter of the unthreaded portion 26 of shank 18 so as to accommodate such misalignments.

The protruding dome-shaped convex portion 46 of race 44 together with the internal bore surface 48 of aperture 30 comprises an annular collar generally designated by reference numeral 50. Collar 50 is large enough and extends sufficiently beyond ribs 40 to prevent captivated conductors from interfering with threads 28. In this regard, the axial length of collar 50, at internal bore surface 48 of aperture 30, preferably is equal to the thickness of clamping plate 14. However, with respect to both axial length and diameter, aperture 30 is of a size suitable to enable plate 14 to rotate or slide freely about the unthreaded portion 26 of shank 18, while simultaneously preventing plate 14 from undesirably interfering with the threaded portion 28 of shank 18 by binding therewith, slipping thereon, or other similar undesirable interferences. This is accomplished by terminating the upper edge 52 of threaded portion 28 as close as possible to the distal extremity of collar 50 so as to form a shoulder or lip against which the distal extremity of collar 50 abuts as shown in FIG. 2, yet collar 50 is free to rotate relative to shoulder 52. By such arrangement, collar 50 will be maintained or captured between the threaded portion of the shank 18 and the ball portion 24 and plate 14 will be permitted to freely rotate relative to the unthreaded portion 26.

To this end, a blank or unthreaded screw 12 is first assembled to the finished clamping plate by insertion into and through aperture 30. To facilitate this, the unthreaded shank of screw 12 has an outer diameter that is slightly less than the diameter of aperture 30 as already mentioned. Threads 28 are then formed in conventional manner as by thread rolling in a suitable die on the lower portion of shank 18 leaving unthreaded the portion 26 adjacent ball portion 24. As a result, the formed threads 28 will have a major thread diameter (crest diameter) greater than both the outer diameter of unthreaded portion 26, as well as the diameter or bore surface 48 of collar 50. Hence, clamping plate 14, subsequent to the thread rolling or forming operation on shank 18 will be permanently fastened about unthreaded portion 26 as a result of plate 14 being captured on the smaller unthreaded diameter portion 26 between the large diametered portion of screw head 16 and screw threads 28.

Turning now to FIGS. 1, 3 and 4, the underside of clamping plate 14 includes four inverted generally V-shaped clamping ribs or jaws 40 with each clamping jaw 40 depending from clamping surface 34. Each clamping jaw 40 has a relatively dull knife-like edge or wedge edge 51 which frictionally grips or imbeds itself into the wires or conductors yet does not damage the conductive portion of the wires. In this manner, clamping jaws 40 prevent the wires from loosening or slipping out from between clamping plate 14 and the confronting surface of the terminal surface.

Preferably, each one of the four depending jaws 40 is formed on clamping surface 34 by a conventional stamping operation such that opposed surface 32 is provided with a plurality of V-shaped grooves 38 diagnonally across and/or inward from one of the four corners 53, respectively, of plate 14. In accordance with the invention, the diagonal positioning of each clamping jaw 40 relative to a corresponding corner 53 of the plate 14 provides clamping surface 34 with a rhombus or diamond-like configuration of jaws 40 with collar 50 being situated within its center. Notably, each jaw 40, forming a leg of the rhombus-like arrangement, extends completely across its associated corner 53 from one of a pair of adjacent edges to the other adjacent edge of said pair. Also, the distal ends 40A of each diagonally extending jaw 40 terminate approximately centrally of a side 36 of the plate 14 as substantially shown in FIGS. 1 and 3.

The above-mentioned rhombus-like arrangement allows any two adjacent clamping jaws 40 each of which forms an approximate right angle with respect to the other to form a herringbone or chevron pair arrangement having its converging end extending away from the center of the plate 14 and in the direction of a corresponding side 36. Although the jaws in each herringbone or chevron pair terminate at side 36 before intersecting each other to define a central section or segment 54 situated generally midway between adjacent corners 53 defining a single side 36, it will be appreciated that depending upon the size of plate 14 the central section 54 will be longer or shorter or even non-existent (i.e., the jaws may intersect). In the preferred embodiment, jaws 40 are arranged at an angle of about 45° with respect to the central axis 55 of plate 14, each side 36 has a length of about 8 mm, each jaw has a length of about 4.4mm, the segment 54 has a length measured along side 36 of about 1 mm, and the plate central aperture 30 has a diameter of about 3.17 mm. The screw 12 employed with such a plate preferably comprises a #6 screw having an unthreaded shank diameter of 3.00 mm, and a major thread diameter of about 3.5 mm after thread rolling.

As a result of the foregoing structure, each segment 54, is provided with a greater compactness or density of jaw structure thereon, to wit, the two converging raised distal ends 40A of clamping jaws 40, than is provided at all the remaining portions of clamping surface 34 inboard of each segment 54. Consequently, greater frictional resistance and clamping force is provided by the distal end portions of the two converging jaws 40 in the vicinity of each central segment 54 when a conductor 57 is placed between clamping plate 14 and a confronting terminal surface 19 under a clamping load as shown, for example, in FIG. 2, than is provided inboard of each segment 54. This enables the captivated wires, if they should start to move or slip, under the influence of the tightening-torque load, to be urged along the path of lesser resistance and lesser clamping load, that is, the conductive wire 57 being clamped is urged inwardly along the path of arrow 60 toward the center of the plate 14.

In the event the conductors actually do slip, they slide inwardly toward the center portion of clamping surface into abutting engagement with collar 50 which, in turn, terminates further slipping and the conductors become substantially permanently trapped or held captive between collar 50 and the area of high frictional resistance and clamping load provided by segment 54. In this fashion the rhombus-like arrangement of clamping jaws 40 provides a means for substantially preventing the tendency for captivated conductors or wires to be squeezed out laterally from beneath clamping plate 14 away from shank 18.

It is to be understood that the above detailed description of embodiments of the invention is provided by way of example only. Various details of design and construction may be modified without departing from the true spirit and scope of the invention as set forth in the appended claims as follows:

We claim:

1. In an electrical terminal clamp assembly of the type for holding an electrically conductive element to an electrical terminal, the improvement comprising:

(a) a screw including a head and a partially threaded shank extending from said head, said head being provided with a convex-shaped bearing portion; and (b) a plate having a first surface and a second surface, said second surface being adaptable for holding said electrically conductive element between said second surface and a surface of said terminal without slipping, said plate also having race means adaptable for receiving therein said shank, said race means having a concave-shaped seating surface on said first surface of the plate for seating said convex-shaped bearing portion of said head, said race means defining a convex-shaped collar means for retaining said plate on an unthreaded portion of said shank without interfering with said threaded portion, and wherein said convex-shaped bearing portion of said head and said race means provide a ball joint means for minimizing frictional resistance between said convex-shaped bearing portion and said concave-shaped seating surface.

2. The terminal clamp assembly as recited in claim 1, wherein said convex-shaped bearing portion is positioned at an underface of said head and comprises a substantially hemispherical form.

3. The terminal clamp assembly as recited in claim 1, wherein said unthreaded portion of said shank is disposed between said convex-shaped portion of said head and said threaded portion, said unthreaded portion of said shank having a diameter less than the diameters of said collar means and said threaded portion.

4. The terminal clamp assembly as recited in claim 1, wherein said first and second sides of said plate are substantially parallel to one another, said race means having a dome-like configuration with respect to said first and second sides, said thickness of said dome-like configured portion being substantially the same thickness as remaining portions of said plate, said race means having an aperture positioned at a vertex portion thereof for receiving said shank.

5. The terminal clamp assembly as recited in claim 1, wherein said plate comprises a rectangular form and said second surface comprises a plurality of ribs depending therefrom, said plurality of ribs forming a rhombus-like configuration on said second surface, said collar means being centered within said rhombus-like configuration.

6. The terminal clamp assembly as recited in claim 5, wherein each one of said ribs forming said rhombus-like configuration extends substantially diagonally across a different one of four corners defined by said rectangular shaped plate.

7. The plate as recited in claim 5, wherein said plate is a pressure plate and has four of said ribs, each one of said four ribs being positioned to fully extend diagonally across a different one of four corners defined by said rectangular shaped plate.

8. The plate as recited in claim 1, wherein said second surface includes thereon at lease two ribs for holding electrical conductors to said electrical terminal by exerting a clamping force on said conductors, said at least two ribs being arranged on said second surface to extend in different diverging directions from a common side segment plate where said at least two raised ribs converge at said common side segment; and wherein said common side segment comprises a greater density of rib area than an area inboard of said common side segment defining said two ribs extending in said different diverging directions, said greater density of rib area enabling said at least two ribs to exert greater clamping forces on said conductors about said common side segment than said areas inboard of said common segment when said plate is under the influence of a tightenting-torque applied to said screw head inserted with an aperture defined by said plate means.

9. The pressure plate as recited in claim 8, wherein said at least two ribs comprise wedge-like edges.

10. In an electrical terminal clamp assembly of the type for holding electrical conductive elements to an electrical device, the improvement comprising:

(a) a screw for detachably fastening the assembly to the device, said screw including a head for providing pressure on a clamping plate, and a partially threaded shank extending from said head, said head being provided with a convex-shaped bearing portion adjacent an under surface thereof; and (b) said clamping plate for holding conductive elements to said device, said clamping plate having a bearing surface for receiving said screw head and a clamping surface, said clamping surface being adaptable for holding said conductive elements between said clamping surface and a surface of said device without slipping, said plate also having a race means adaptable for receiving therein said shank, said race means having a concave-shaped seating surface on said bearing surface of said clamping plate for seating said convex-shaped bearing portion of said head and a convex-shaped collar means depending from said clamping surface, said collar means depending from said clamping surface in a manner to abut against the terminating portion of the threaded portion of said partially threaded shank by which said collar means retains said clamping plate on an unthreaded portion of said partially threaded shank without interfering with said threads thereof, and wherein said convex-shaped bearing portion of said head and said race means provide a ball joint means when said clamping screw is assembled into said clamping plate, said ball joint means enabling an entire amount of tightening-torque applied to said head to be converted to substantially an equivalent amount of clamping force at said clamping surface by decreasing frictional resistance between said convex-shaped bearing portion and said concave-shaped seating surface.

11. A clamping plate of a kind for use in an electrical terminal clamp assembly for holding electrical conductors to an electrical device comprising:

(a) a first surface for receiving a bearing surface of a head of a terminal screw; and (b) an opposed second surface including therein at least two raised ribs for exerting a clamping force on said conductors, said at least two ribs arranged on said opposed second surface to extend in different diverging directions from a common side segment plate where said at least two raised ribs converge at said common side segement, each one of said at least two ribs being raised above said opposed second surface for substantially the entire extent thereof and being of substantially constant height above said second surface; and (c) an aperture in said plate for receiving therein a shank of said screw.

12. The pressure plate as recited in claim 11, wherein said first surface further comprises a concave-shaped portion thereof for receiving therein a spherical-shaped bearing shoulder of said screw head, and wherein said opposed second surface further comprises a convex-shaped portion thereof for retaining said plate inseparably connected to said screw without damaging external threads defined by said screw, said aperture being free of internal threads and being positioned at a vertex portion of said convex-shaped portion.

13. The pressure plate as recited in claim 12 further comprises at least four said ribs, said four ribs being arranged on said second side in a rhombus-like configuration, said convex-shaped portion being positioned substantially in a central portion of said rhombus-like configuration each one of said four ribs being raised above said opposed second surface for substantially said entire extent thereof and being of substantially said constant height above said second surface.

14. The pressure plate as recited in claim 13, wherein said plate comprises a rectangular shape, said first surface and said opposed second surface having substantially flattened shapes, each one of four ribs being positioned to fully extend diagonally across a different one of four corners defined by said rectangular shaped plate; and wherein said rhombus-like configuration enables any two said ribs, which are positioned at an oblique angle with respect to one another, to converge at an associated one of four said common side segements, each said common side segment being positioned between different opposed corners defined by said rectangular shaped plate, each pair of said two ribs, forming said oblique angle, extending from said associated common segment in different diverging directions, each said common side segment having a greater density of rib area than areas inboard of each said common side segment enabling the associated common side segment to exert greater clamping force on said conductors than said areas inboard of each said associated common side segment when said pressure plate is under the influence of a tightening-torque applied to said screw inserted in said aperture.

* * * * *